United States Patent [19]

Paton et al.

[11] 4,455,852

[45] Jun. 26, 1984

[54] METHOD FOR PRODUCING SHAPES HAVING CIRCULAR CORRUGATIONS

[75] Inventors: Boris E. Paton; Vladimir N. Samilov, both of Kiev; Grigory P. Ivaschenko; Alexandr V. Krasjukov, both of Dnepropetrovsk, all of U.S.S.R.; Vladimir M. Balitsky, deceased, late of Kiev, U.S.S.R., by Oxana V. Balitskaya, administrator

[73] Assignee: Institut Elektrosvarki Imeni E. O. Patona, Kiev, U.S.S.R.

[21] Appl. No.: 346,050

[22] PCT Filed: May 30, 1980

[86] PCT No.: PCT/SU80/00089

§ 371 Date: Jan. 26, 1982

§ 102(e) Date: Jan. 26, 1982

[87] PCT Pub. No.: WO81/03442

PCT Pub. Date: Dec. 10, 1981

[51] Int. Cl.[3] ..... B21D 22/14; B21D 22/18; B21D 15/04

[52] U.S. Cl. ..... 72/82; 72/105; 72/370

[58] Field of Search ..... 72/80–85, 72/91, 105, 113, 379, 469, 67, 370

[56] References Cited

U.S. PATENT DOCUMENTS

| | | | |
|---|---|---|---|
| 602,926 | 4/1898 | Zuhlke | 72/83 |
| 1,456,069 | 5/1923 | Mallory | 72/105 |
| 1,711,075 | 4/1929 | Zimmerman | 72/84 |
| 3,444,589 | 5/1969 | Bowin | 425/396 |

FOREIGN PATENT DOCUMENTS

| | | | |
|---|---|---|---|
| 285827 | 7/1915 | Fed. Rep. of Germany | 29/6.2 |
| 2252091 | 5/1974 | Fed. Rep. of Germany | 72/85 |
| 6749 | 1/1981 | Japan | 72/84 |
| 173600 | 9/1965 | U.S.S.R. | 72/379 |
| 441068 | 12/1974 | U.S.S.R. | 72/379 |

*Primary Examiner*—Lowell A. Larson

*Attorney, Agent, or Firm*—Fleit, Jacobson, Cohn & Price

[57] ABSTRACT

Shapes with circular corrugations are produced by spinning a sheet metal blank under the action of oppositely directed deforming and backing forces. The blank is given the configuration of an envelope of revolution with a continuously diverging flare and is secured at the end nearest to the geometrical apex of the flare, and the circular corrugations are formed sequentially from the smaller towards the larger diameter by applying a concentrated deforming force to the inside surface of the blank, the deforming force being directed along the blank axis.

6 Claims, 8 Drawing Figures

METHOD FOR PRODUCING SHAPES HAVING CIRCULAR CORRUGATIONS

TECHNICAL FIELD

The present invention relates to metalforming technique and is specifically concerned with methods for producing shapes having circular corrugations from sheet metal blanks by the spinning process.

BACKGROUND ART

Corrugated disk-typed shapes are presently produced from sheet metal mainly by stamping. With this technique, however, a blank is subjected to deformation over the entire surface simultaneously, which requires considerable forces. In addition, producing shapes having deep corrugtions involves the use of a set of dies with progressively increasing depth of impressions and necessitates annealing between operations. This entails a high power consumption with a rather low productive capacity.

There is also known a method for producing shapes having circular corrugations, wherein the corrugations are spinned by acting upon a sheet metal blank with oppositely directed deforming and backing forces (USSR inventor's Certificate No. 441,068, issued Aug. 30, 1974 Int. Cl. B21 D 13/10). In this method, disks having sawtooth-section corrugations are produced from blanks in the form of the development of a cone. Such a blank is deformed at the points of apices of all the corrugations over one of radial sections of the blank; the process proceeds by progressively extending the zone of deformation and passing from one radial section to another. A corrugated disk thus produced has an unclosed surface, which will necessitate an additional operation of joining and fastening together edges of a complex contour and hence involve additional labour and power consumption. Moreover, accomplishing this method calls for an apparatus with shaping members (spinning tools) capable of varying the distance with respect to one another; this entails a constructional complexity of the apparatus and tooling to practice the method.

The invention is based on the problem to provide a method for producing shapes having circular corrugations from sheet metal, which method makes it possible to produce such shapes with a broad range of dimensions and substantially any depth of the circular corrugations through changing the configuration of a blank by acting thereupon with a concentrated deforming force and offers at the same time low labour and power consumption.

DISCLOSURE OF INVENTION

The problem is solved by the provision of a method for producing shapes having circular corrugations through forming the corrugations by the spinning process which involves acting upon a sheet metal blank with oppositely directed deforming and backing forces, in which method the blank is given the configuration of an envelope of revolution with a continuously diverging flare and is secured at the end nearest to the geometrical apex of the flare, and the circular corrugations are formed sequentially from the smaller towards the larger diameter of the blank by applying a concentrated deforming force to the inside surface of the blank, the deforming forces being applied along the axis of the blank.

Such a method for producing shapes having circular corrugations offers a low power consumption, inasmuch as a blank in the form of a flare readily lends itself to bending (turning out) at the points of application of the deforming and backing forces, i.e. at the areas of forming the circular corrugations. The same fact accounts for the simplicity of the method and possibility of forming corrugations with essentially any depth.

The small deforming forces in turn lower the requirements placed upon the construction of the tooling needed to accomplish the method and reduce the metal content of the latter.

Owing to the fact that the process involves predominantly a bending deformation, the surface quality of formed circular corrugations is close to that of the blank.

Finally, one of the prime attractions of the proposed method lies in that the corrugated disks produced, when acted upon by external forces (such as pressure), can take a configuration close to that of the blank, which is essential for displacing diaphragms of fuel systems.

It is advisable that a blank be pre-extended by the deforming force at the circular area of a corrugation to be formed till producing a circular shoulder. This will facilitate forming the corrugations when the blank is of a higher stiffness.

It is feasible that the point of application of the deforming force be moved along a line corresponding to the contour of that wall of each corrugation which is disposed nearer to the blank axis. This will allow to increase the depth of the circular corrugations as well as to produce disks having circular corrugations from blanks with a spherical, parabolic, and like surface.

BRIEF DESCRIPTION OF DRAWINGS

The invention will now be explained by way of a detailed description of the method for producing shapes having circular corrugations and examples of practicing thereof with reference to the accompanying drawings in which like parts are identified by like reference numerals and in which.

BEST MODE FOR CARRYING OUT THE INVENTION

Figure 1:
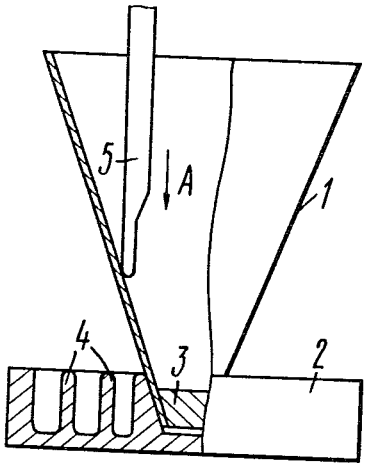
FIG. 1 diagrammatically illustrates a blank for producing a shape and the tooling to accomplish the method.

A blank 1 (FIG. 1) in the form of a closed envelope of revolution with a continuously diverging flare is installed by its end nearest to the geometrical apex of the flare on a die 2, centered, and secured by a hold-down 3. The die 2 has concentric ribs 4 spaced from one another at a distance equal to the spacing of the corrugations.

To effect the deforming force, the tooling of the method comprises a spinning tool 5 whose thickness and width depend on the dimensions of the corrugation to be formed. The working surface (end) of the spinning tool 5, contacting the surface of the blank 1, is rounded off and made of a material which promotes sliding (such as of brass). For the same purpose, grease is applied to the inside surface of the blank 1.

The die 2 with the blank 1 secured thereto is set in rotation. The spinning tool 5 is brought within the blank and positioned radially so that its end is substantially at the centre of a groove defined by the first and second (counting from the mandrel centreline) ribs.

The spinning tool 5 is moved along the axis of the blank 1 (as indicated by the arrow A) until it contacts the inside surface of the latter.

Figure 2:
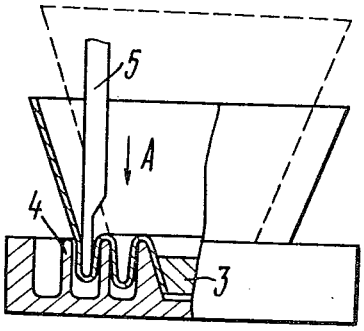
FIG. 2 diagrammatically illustrates the process of sequentially forming circular corrugations.
Figure 3:
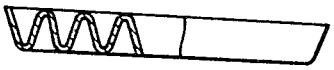
FIG. 3 is a cross-sectional view of a shape having annular corrugations produced from a blank in the form of a truncated cone.

A further longitudinal motion of the spinning tool 5 gives rise to a concentrated deforming force acting from the side of the tool 5 and to a backing force acting from the side of that rib 4 of the die 2 which is disposed nearer to the axis of the blank 1. Bending and rolling over the end of the spinning tool 5, the sheet metal of the blank turns out into a mirror position to form a corrugation wall disposed nearer to the blank axis. The other wall of the corrugation is formed by the undeformed side of the blank 1, displaced to a new position up to the contact with the other rib 4 of the groove of the die 2. After the corrugation of a predetermined depth has been formed, the spinning tool 5 is withdrawn to the initial position and traversed radially from the centre towards the periphery of the blank for a distance equal to the spacing of the corrugations, and the second (counting from the centreline of the shape) corrugation (FIG. 2) is formed. The process is continued until a shape (FIG. 3) with the desired amount of corrugations has been produced.

The spinning tool may take the form of a roller (not shown) with a flange whose height somewhat exceeds the depth of the corrugation to be formed.

Figure 4:
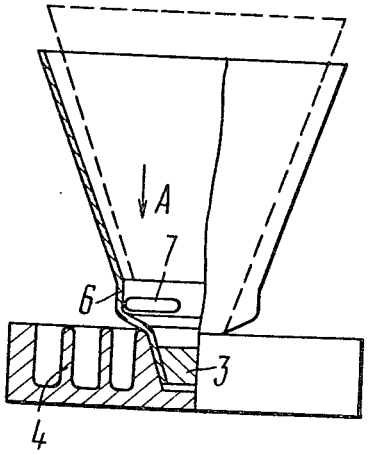
FIG. 4 diagrammatically illustrates the process of forming a circular shoulder on a higher-stiffness blank.

According to a modification of the invention, the blank 1 is preextended by the deforming force at the circular (FIG. 4) area of a corrugation to be formed till producing a circular shoulder 6 (FIG. 4). This operation is performed by a spinning tool in the form of a roller 7 whose axis is substantially parallel with the axis of rotation of the blank 1. The roller 7 is fed along the axis of the blank 1 into contact with the inside surface of the latter and until the circular shoulder 6 is formed, after which the roller 7 is withdrawn out of the blank 1 and replaced by a spinning tool such as the plate 5 or a roller (not shown) whose rotational axis is disposed transversely with respect to the blank axis, and forming a corrugation in the above-described manner is started. To form the next corrugation, the cycle is repeated.

According to another modification of the invention, the point of application of the deforming force, i.e. the end of the spinning tool 5, is moved along a line corresponding to the contour of that wall of each corrugation which is disposed nearer to the blank axis.

Figures 5A, 5B, 5C:
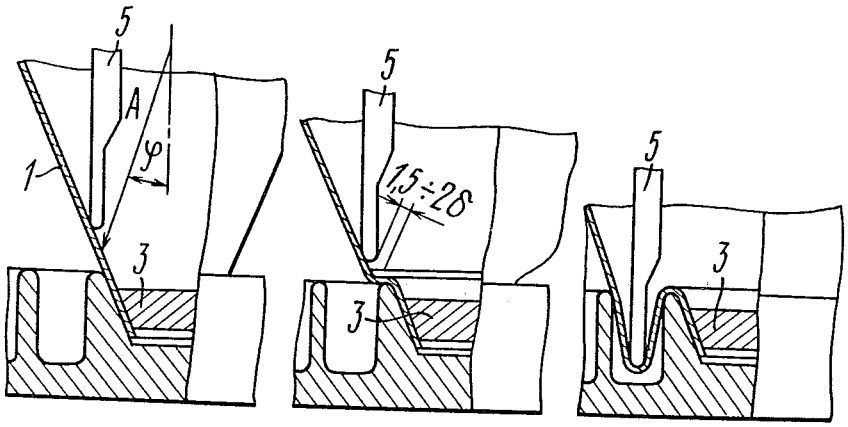
FIGS. 5*a, b, c* diagrammatically illustrates the sequence of the process of producing a shape having circular corrugations when feeding a spinning tool at an angle to the blank axis.

When producing a shape from a blank having the configuration of a cone-shaped envelope (FIGS. 5*a, b, c*), the spinning tool 5 is fed straightlinearly at an angle $\rho$ equal to the inclination angle of the surface of that wall of each corrugation which is disposed nearer to the axis of the blank 1. At the initial moment of forming the corrugations, the spinning tool 5 should be positioned so (FIG. 5*b*) that its side surface is spaced from the outer side of a corresponding rib at 1.5 to $2\delta$, where $\delta$ is the thickness of the sheet metal.

Figure 6:
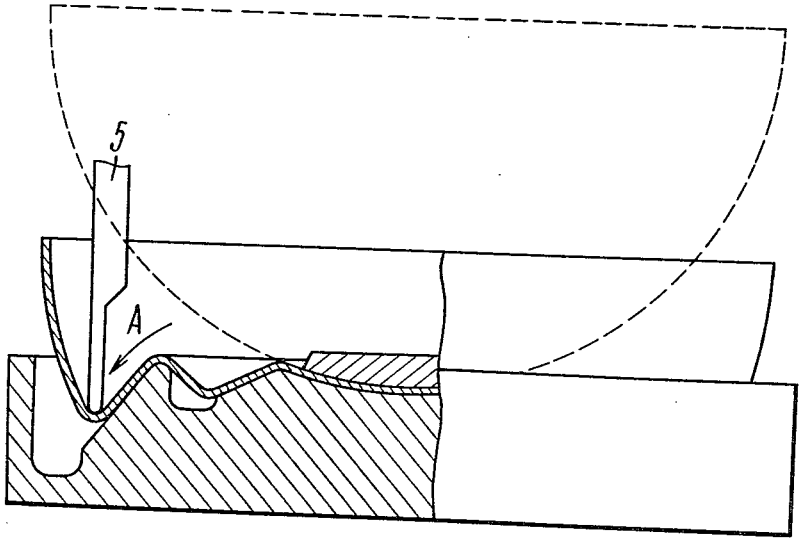
FIG. 6 diagrammatically illustrates the process of producing a shape having circular corrugations from a hemispherical blank shown in a dashed line.

When producing a shape from a blank having the configuration of a hemisphere (FIG. 6), the spinning tool is fed so that its end, i.e. the point of application of the deforming force, follows a curved line corresponding to the contour of that wall of each corrugation which is disposed nearer to the axis of the blank 1.

This is attained firstly by that the spinning tool is caused to follow a curvilinear template (not shown) corresponding to the surface of a circular area of the sphere, and secondly the surface of the rib 4 disposed nearer to the axis of the blank 1 is also given the configuration of the circular area of the sphere.

EXAMPLE 1

A diaphragm was produced from a blank having the configuration of a truncated cone with a larger diameter of 620 mm. The sheet metal of the blank was 0.15 mm thick low-carbon steel.

Conditions of the method:

blank rotation, 80 m/min:

axial feed of spinning tool, 0.2 mm/rev.

A disk with fifty 4 mm deep circular corrugations was produced. The surface finish of the corrugations was close to that of the blank. The disk with circular corrugations was produced for use as a displacing diaphragm of a conical tank.

EXAMPLE 2

A diaphragm was produced from a blank having the configuration of a truncated cone with a larger diameter of 400 mm. The sheet metal of the blank was 0.1 mm thick commercially pure titanium.

Conditions of the method:

blank rotation, 60 m/min;

axial feed of spinning tool, 0.1 mm/rev.

A disk with twenty 5 mm deep corrugations was produced. The surface finish of the corrugations was close to that of the blank.

EXAMPLE 3

A diaphragm with a single corrugation was produced from a blank having the configuration of a truncated cone with a larger diameter of 200 mm. The sheet metal of the blank was 0.1 mm thick commercially pure titanium.

Conditions of the method:

blank rotation, 50 m/min;

feed of spinning tool at an angle of $\rho=10°$, 0.2 mm/rev.

A diaphragm with a single 50 mm deep corrugation was produced.

EXAMPLE 4

A disk with circular corrugations was produced from a blank having the configuration of a truncated cone with a larger diameter of 1,200 mm. The sheet metal of the blank was 1 mm thick chromium-nickel stainless steel.

Conditions of the method:

blank rotation, 35 m/min;

axial feed of spinning tool, 0.5 mm/rev.

A disk with twenty 40 mm deep corrugations was produced.

EXAMPLE 5

A disk with circular corrugations was produced from a hemispherical blank with a base diameter of 500 mm. The sheet metal of the blank was 0.3 mm thick chromium-nickel stainless steel.

Conditions of the method:

blank rotation, 30 m/min;

template-controlled feed, 0.2 mm/rev.

A disk with fifteen circular corrugations with a depth varying from 5 to 20 mm was produced.

The disk with circular corrugations was produced for use as a diaphragm of a spherical tank of a displacing system.

INDUSTRIAL APPLICABILITY

The invention is particularly useful for producing ring-shaped corrugated disks used, depending on their purpose, as membranes, diaphragms and other shapes capable of varying within a broad range their dimensions along the rotational axis under the action of external forces.

We claim:

1. A method for producing shapes having circular corrugations by means of a spinning process, said method comprising:

(a) providing a blank in the form of a closed envelope of revolution having a continuously diverging flare;

(b) securing the blank against a die having a plurality of spaced concentric ribs defining spaced concentric grooves therebetween of different diameters;

(c) providing a first spinning tool;

(d) spinning the blank about its axis;

(e) aligning the spinning tool with one of the grooves in the die;

(f) moving the spinning tool relative to the blank toward the die to provide a deforming force to form a corrugation wall;

(g) withdrawing the spinning tool from the corrugation wall;

(h) moving the tool radially relative to the spinning axis to align the tool with another groove in the die;

(i) moving the spinning tool relative to the blank toward the die to provide a deforming force to form a second corrugation wall; and (j) withdrawing the tool from the other groove.

2. The method of claim 1 including the steps of:

(a) providing a second spinning tool in the form of a roller in which the axis of the roller is parallel to the spinning axis of the blank;

(b) forming a circular shoulder in the blank adjacent a groove in the die prior to applying forces by means of the first spinning tool by moving the second spinning tool axially of the blank; and (c) producing a corrugation profile by means of the first spinning tool.

3. The method of claim 1 including the step of moving the first spinning tool along the contour of the wall of a groove in the die to provide a forming force locally along the perimeter of the corrugation being formed.

4. The method of claim 3 wherein the moving step is along a line corresponding to the innermost wall of the groove of the die relative to the axis of the blank and said method begins at the innermost groove nearest the spinning axis of the blank and gradually progresses radially outwardly toward the periphery of the blank.

5. The method of claim 1 wherein the moving step is performed in an axial direction and a forming force is applied at an angle to the spinning axis of the blank, the angle being equal to the inclination angle of the groove internal wall relative to the spinning axis of the blank.

6. The method of claim 1 wherein the moving step is performed in an angular direction relative to the axis of the blank and along inclined sidewalls of the grooves, the sidewalls being inclined relative to the spinning axis of the blank, and includes moving the spinning tool along the contour of the groove sidewalls to provide a forming force.

* * * * *